United States Patent [19]

Thompson et al.

[11] Patent Number: 4,727,823

[45] Date of Patent: Mar. 1, 1988

[54] MAGNETIC ROLL STRUCTURE FOR TRANSPORTING SINGLE COMPONENT MAGNETIC DEVELOPER

[75] Inventors: Michael D. Thompson, Rochester; Clifford W. Imes, IV, Williamson, both of N.Y.

[73] Assignee: Xerox Corporation, Stamford, Conn.

[21] Appl. No.: 737,973

[22] Filed: May 28, 1985

[51] Int. Cl.[4] ..... G03G 15/09

[52] U.S. Cl. ..... 118/652; 118/657

[58] Field of Search ..... 118/657, 652

[56] References Cited

U.S. PATENT DOCUMENTS 3,392,432 7/1968 Naumann ..... 118/657 X 4,265,990 5/1981 Stolka et al. ..... 430/59

*Primary Examiner*—Bernard D. Pianalto

[57] ABSTRACT

A new and improved structure for transporting single component magnetic developer for developing latent electrostatic images or for removing residual developer from a charge-retentive surface. In one embodiment of the invention narrow metal strips are embedded in the outer shell or cylinder of a conventional magnetic roll structure. The strips are very pointed adjacent the outer periphery of the shell. The sharp tips ensure a high magnetic field gradient when the magnetic roll disposed internally of the shell is rotated. The thinness of the strips causes them to respond to only the radial component of the magnetic field. Each strip responds to the oscillating radial field component slightly out of phase with its adjacent strip thereby creating a wave gradient along the surface which pulls and tumbles developer over the surface.

5 Claims, 3 Drawing Figures

MAGNETIC ROLL STRUCTURE FOR TRANSPORTING SINGLE COMPONENT MAGNETIC DEVELOPER

BACKGROUND OF THE INVENTION

This invention relates to printing machines, and more particularly, to a development and/or cleaning apparatus for developing latent electrostatic images on a charge-retentive surface or removing residual developer therefrom and, more particularly, to an improved magnetic roll structure for presenting single component magnetic developer to a charge-retentive surface such as a photoconductor or removing residual developer therefrom.

In the art of xerography or other similar image reproducing arts, a latent electrostatic image is formed on a charge-retentive surface such as a photoconductor which generally comprises a photoconductive insulating material adhered to a conductive backing. The photoconductor is first provided with a uniform charge after which it is exposed to a light image of an original document to be reproduced. The latent electrostatic images, thus formed, are rendered visible by applying any one of numerous pigmented resins specifically designed for this purpose. In the case of a reusable photoconductive surface, the pigmented resin, more commonly referred to as developer or toner which forms the visible images is transferred to plain paper.

Subsequent to the transfer of the developed image the charge-retentive surface is prepared for further use by removing the residual developer therefrom. This can be accomplished by the same structure that is used for the development of the latent image.

It should be understood that for the purposes of the present invention, which relates to the development of latent electrostatic images with developer particles or removing residual developer particles from a charge-retentive surface subsequent to transfer, the latent electrostatic image may be formed by means other than by the exposure of an electrostatically charged photosensitive member to a light image of an original document. For example, the latent electrostatic image may be generated from information electronically stored or generated in digital form which may afterwards be converted to alphanumeric images by image generation electronics and optics. However, such image generation electronic and optic devices form no part of the present invention.

One general approach to developing electrostatic images, which is often used commercially, is to attract particulate developer to an applicator surface from the outlet of a developer sump or housing and move the applicator into a transfer relation with the imaging member so that the particles can adhere to the member in accordance with the image pattern. Most commonly, the applicator is a roller which rotates so that its peripheral surface moves between the sump outlet and a zone in transfer relation with the imaging member. Adherence of the developer to such applicator rollers can be accomplished in various ways including, e.g., adhesive or electrical attraction, but the most prevalent commercial technique utilizes magnetic attraction and applicators using this technique are often called magnetic brushes. The same structure can be employed for removing residual developer from a charge-retentive surface.

Developers used with such magnetic brushes can be single component or they may comprise a mixture of two components in which case the toner particles are electrostatically attracted to magnetically attractable carrier particles in the developer mixture. The magnetic brush applicators can take various forms, however, a typical configuration comprises a non-magnetic outer cylinder which surrounds an array of magnets located within its inner periphery. Developer movement is effected by rotation of the outer cylinder and/or the interior magnet array.

Although single component developers offer many advantages over two component systems it is necessary to magnetically load them in order to be able to effect proper development of electrostatic images with a magnetic roll or to satisfactorily remove residual developer from the charge-retentive surface subsequent to image transfer. In the case where low magnetic loading is desired conventional magnetic roll structures do not produce satisfactory results.

Conventional magnetic roll structures must be placed very close to the charge-retentive surface because the magnetic field falls off very rapidly with distance. The spacing tolerance is quite critical with conventional structures.

As will be appreciated, a single component magnetic developer transport which can attract such developers even when they contain small quantities of magnetic material is desirable.

As will be further appreciated a single component magnetic developer transport which is less sensitive to spacing tolerances is also desirable.

SUMMARY OF THE INVENTION

In order to effect efficient transporting of single component magnetic developer, especially in the case where the developer contains only a small amount of magnetic particles therein, we have provided a new and improved magnetic roll. To this end we have provided, in one embodiment of the invention, narrow strips of ferromagnetic material around the outer cylinder of a conventional magnetic roll structure. This magnetic roll structure produces a field gradient which moves along the surface of the cylinder when the cylinder and/or magnetic roll rotates. A stronger pulling or attraction force compared to conventional magnetic roll structures is present along with the tumbling effect normally present in a conventional structures.

The metal strips may be embedded in the outer cylinder of the magnetic roll structure or they may be embedded in a arcuate member which is supported adjacent to the surface of the cylinder. Where the metal strips are embedded in the cylinder they extend about the entire periphery thereof. The arcuate member is disposed intermediate the cylinder and the chargeretentive surface and its size is equivalent to a section of the cylinder corresponding to only a few degrees of arc of the cylinder. The separate member comprises magnetic steel shims separated by aluminum shims.

The strips embedded in the shell come to a point at the outermost surface of the cylinder and are thus very sharp. This sharp tip ensures a high magnetic gradient and their thinness makes them effectively respond to only the radial component of the magnetic field. Each strip responds to the oscillating radial field component slightly out of phase with its adjacent strip thereby creating a gradient wave along the surface which causes pulling and tumbling of the developer over the surface.

DETAILED DESCRIPTION OF THE DRAWINGS

Other aspects of the present invention will become apparent as the following description proceeds with reference to the drawings wherein.

DETAILED DESCRIPTION OF THE INVENTION

Inasmuch as the art of electrophotographic printing is well known, the various processing stations employed in the printing machine illustrated in FIG. 1 will be described only briefly.

Figure 1:
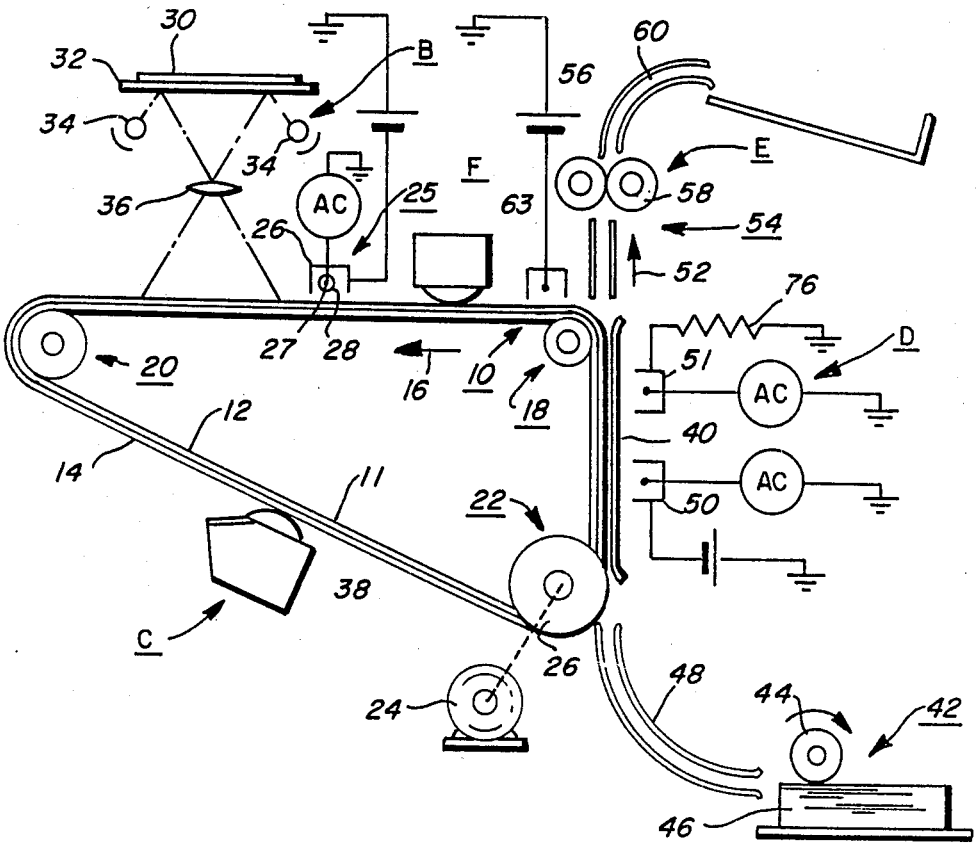
FIG. 1 is a schematic elevational view depicting an electrophotographic printing machine incorporating the present invention.

As shown in FIG. 1, the printing machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photoconductive belt of the foregoing type is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof.

Belt 10 is entrained about stripping roller 18, tension roller 20 and drive roller 22. Roller 22 is coupled to motor 24 by suitable means such as a drive chain. Belt 10 is maintained in tension by a pair of springs (not shown) which resiliently urge tension roller 20 against belt 20 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device indicated generally by reference numeral 25 charges the layer 12 of belt 10 to a relatively high, substantially uniform negative potential.

A suitable corona generating device for negatively charging the photoconductive belt 10 comprises a conductive shield 26 and corona wire 27, the latter of which is coated an electrically insulating layer 28 having a thickness which precludes a net dc corona current when an A.C. voltage is applied to the corona wire when the shield and photoconductive surface are at the same potential.

Next, the charged portion of the photoconductive belt is advanced through exposure station B. At exposure station B, an original document 30 is positioned facedown upon a transparent platen 32. The light rays reflected from original document 30 form images which are transmitted through lens 36. The light images are projected onto the charged portion of the photoconductive belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 disposed in a developer housing or sump 39 advances developer into contact with the electrostatic latent image. The latent image attracts the developer particles from the developer roller or roll thereby forming visible images on the photoconductive belt. The developer roll 38 may comprise any conventional construction known in the art of printing.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the upper most sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays ions of a suitable polarity onto the backside of sheet 40 so that the toner powder images are attracted from photoconductive belt 10 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder images to sheet 40. Preferably, fuser assembly 54 includes a heated fuser roller 56 adapted to be pressure engaged with a back-up roller 58 with the toner powder images contacting fuser roller 56. In this manner, the toner powder images are permanently affixed to sheet 40. After fusing, chute 60 guides the advancing sheet 40 to catch tray 62 for removal from the printing machine by the operator.

A preclean dicorotron 63 is provided for exposing the residual toner and contaminants to positive charges to thereby narrow the charge distribution thereon so that a negatively biased cleaning roller or brush 64, to be discussed hereinafter, will be more effective in removing them.

At the cleaning station F, residual toner and contaminants or debris such as paper fibers and Kaolin are removed from the photoreceptor surface by means of brush 64 which is preferably a magnetic brush structure which is rotated in the direction of the arrow 66 via a motor (not shown). In a xerographic or similar type system of the type herein disclosed, the brush 64 will remove the residual toner or developer from the photoreceptor. The toner so removed is carried by the brush into a cleaner housing or sump 67 wherein the residual toner is removed from the brush so that the brush can continue to attract residual toner from the charge-retentive surface. Such removal is accomplished by a scraper blade (not shown).

Figure 2:
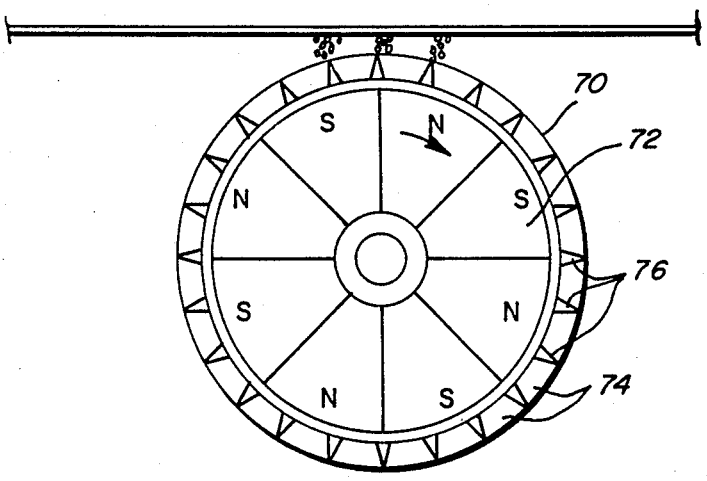
FIG. 2 is an enlarged schematic view of a single component magnetic developer transport.

As viewed in FIG. 2, the developer roll or transport structure 38 comprises a stationary shell or cylinder 70 and a cylindrical magnet 72. The magnet 72 is supported for rotation so that the alternately disposed north and south poles create a pulsating magnetic field. A plurality of thin ferromagnetic strip members 74 are embedded in the cylinder or shell. Each of the strip members is provided with a sharp tip portion 76 adjacent the outermost surface of the shell 70.

This magnetic roll structure produces a field gradient which moves along the surface of the cylinder when the cylinder and/or magnetic roll rotates. A stronger pulling or attraction force compared to conventional magnetic roll structures is present along the tumbling effect normally present in conventional structures.

The sharp tips of the strip members ensure a high magnetic gradient and their thinness makes them effectively respond to only the radial component of the magnetic field. Each strip responds to the oscillating radial field component slightly out of phase with its adjacent strip thereby creating a gradient wave along the surface which causes pulling and tumbling of the developer over the surface.

Figure 3:
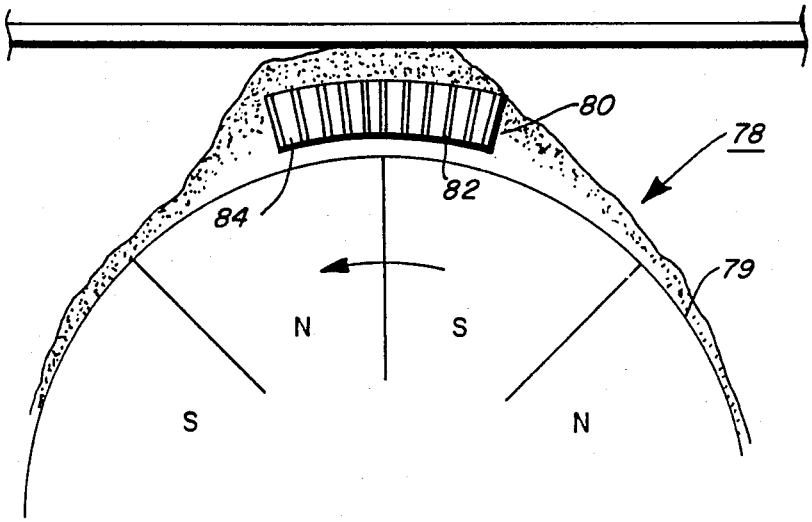
FIG. 3 is an enlarged schematic view of a modified embodiment of the device shown in FIG. 2.

As viewed in FIG. 3, a modified form of the developer roll structure 38 comprises developer structure 78. The structure 78 comprises a roll magnet 79 rotatably supported adjacent an arcuate member 80. The member 80 comprises magnetic steel shims 82 approximately 0.020 inch (0.05 mm) in thickness separated by non-magnetic shims 84 fabricated from aluminum or plastic and having a thickness of approximately 0.032 inch (0.08 mm). Functionally, the shims 82 behave in the same manner as the strip members 74. In the case of development the developer material which is carried on the surface of the magnetic roll structure 78 is carried thereby to the top of the member 80 after which it is moved thereacross by the oscillating radial field component produced by the shims 82 due to the rotation of the roll magnet 79.

When used for residual developer removal the residual developer on the charge-retentive surface is first attracted to the member 80 and it moves across the member 80 and is deposited onto the roll magnet 79 to be carried to a remote location where it is scraped therefrom.

As will be appreciated, the roll structures 38 and 78 can be used equally as well for removing single component magnetic developer from a charge-retentive surface.

We claim:

1. Developer transporting apparatus for moving single component magnetic developer between a charge-retentive surface and a sump, said apparatus comprising:

a sump for containing a quantity of developer particles;

a roll magnet having at least one north and one south pole for creating an oscillating magnetic field in the vicinity of said charge-retentive surface; and a magnetic field amplifying structure comprising plurality of magnetic members embedded in a non-magnetic support and equally spaced therein and being narrower than the spacing between adjacent magnetic members, said structure being disposed intermediate said chargeretentive surface and said roll magnet, said magnetic members being pointed at the end thereof closest to said charge-retentive surface.

2. Apparatus according to claim 1 wherein said support comprises a cylinder within which said roll magnet is concentrically disposed.

3. Apparatus according to claim 1 wherein said support comprises an arcuate member comprising said magnetic members spaced apart by non-magnetic members.

4. Apparatus according to claim 1 wherein said roll magnet comprises a developer roll for presenting developer to said charge-retentive surface.

5. Apparatus according to claim 1 wherein said roll magnet comprises a cleaning roll for removing residual developer from said charge-retentive surface.

* * * * *